US008904692B2

(12) United States Patent
Ballard

(10) Patent No.: US 8,904,692 B2
(45) Date of Patent: Dec. 9, 2014

(54) BUTT PAD APPARATUS FOR A FIREARM

(75) Inventor: Michael W. Ballard, Cerritos, CA (US)

(73) Assignee: Brookshire Tool & Mfg Co., Inc., South Gate, CA (US)

( * ) Notice: Subject to any disclaimer, the term of this patent is extended or adjusted under 35 U.S.C. 154(b) by 170 days.

(21) Appl. No.: 13/344,766

(22) Filed: Jan. 6, 2012

(65) Prior Publication Data

US 2013/0174461 A1 Jul. 11, 2013

(51) Int. Cl.
*F41C 23/08* (2006.01)
*F41C 23/20* (2006.01)

(52) U.S. Cl.
CPC ..... *F41C 23/08* (2013.01); *F41C 23/20* (2013.01)
USPC ..... 42/74

(58) Field of Classification Search
CPC ..... F41C 23/06; F41C 23/08; F41C 23/20
USPC ..... 42/74
See application file for complete search history.

(56) References Cited

U.S. PATENT DOCUMENTS

| | | | | | |
|---|---|---|---|---|---|
| 1,325,152 | A * | 12/1919 | Hawkins | 42/74 |
| 1,328,924 | A * | 1/1920 | Kennedy | 42/74 |
| 1,847,777 | A * | 3/1932 | Morgan | 42/73 |
| 3,007,272 | A * | 11/1961 | Pachmayr | 42/74 |
| 4,683,671 | A * | 8/1987 | Farrar | 42/74 |
| 5,471,776 | A * | 12/1995 | Chesnut et al. | 42/74 |
| 7,152,356 | B2 * | 12/2006 | Sims | 42/74 |
| 2001/0011434 | A1 * | 8/2001 | Gussalli Beretta | 42/74 |
| 2003/0226304 | A1 * | 12/2003 | Murello | 42/74 |
| 2009/0300949 | A1 * | 12/2009 | Frederick et al. | 36/35 R |

FOREIGN PATENT DOCUMENTS

DE 202011052542 * 2/2012

* cited by examiner

*Primary Examiner* — Stephen M Johnson
(74) *Attorney, Agent, or Firm* — Bennet K. Langlotz; Langlotz Patent & Trademark Works, Inc.

(57) ABSTRACT

A butt pad apparatus is disclosed herein. In various aspects, the butt pad apparatus includes a plate and a recoil pad attachable to the plate such that a chamber is defined therebetween. The recoil pad with plate attached thereto may be adapted for attachment to a butt of a stock. In various aspects, the butt pad apparatus includes an insert removably receivable within the chamber, and the insert may be formed of an elastomeric material. This Abstract is presented to meet requirements of 37 C.F.R. §1.72(b) only. This Abstract is not intended to identify key elements of the apparatus and methods disclosed herein or to delineate the scope thereof.

18 Claims, 3 Drawing Sheets

BUTT PAD APPARATUS FOR A FIREARM

BACKGROUND OF THE INVENTION

Various firearms including rifles, shotguns, and carbines recoil when discharged. When the firearm is employed, a stock of the firearm is placed against the shoulder, so that the recoil resulting from discharge of the firearm may drive the butt of the firearm's stock into the user's body thereby causing discomfort to the user. This discomfort may include impact upon the user's body, jarring, bruising, or other trauma. Even without injury, some shooters may anticipate the discomfort and "flinch" in anticipation of the shot, thereby impairing accuracy. The discomfort caused by recoil may be increased by rapid discharge of the firearm such as that of a semi-automatic. A large number of discharges such as a user may experience when engaged in target practice or in a shooting sport such as trap shooting may increase the discomfort to the user caused by recoil. Larger caliber or gauge firearms may also increase the discomfort to the user due to recoil.

Existing systems to reduce recoil use flexible materials to absorb recoil energy. Soft elastomeric materials generate more comfort, but are less durable, and are also "sticky" in that they overly grip the user's clothing. Firmer materials are less comfortable, but more durable, and enable the shooter to shift position of the pad on the shoulder more easily without "sticking."

The optimum level of recoil protection depends on several factors, including user stature and preference, rifle type, ammunition caliber, and clothing. Intended usage is also a factor. In bird hunting, many shots are taken, suggesting more comfortable recoil protection, while with deer hunting, few shots are taken, suggesting less recoil protection is needed. Even if a pad is available with optimal qualities for a given application, the owner may need a different pad for other uses.

Accordingly, there is a need for improved apparatus that reduces the discomfort to the user resulting from recoil of a firearm, while addressing the diverse needs for recoil protection.

BRIEF SUMMARY OF THE INVENTION

These and other needs and disadvantages may be overcome by the apparatus disclosed herein. Additional improvements and advantages may be recognized by those of ordinary skill in the art upon study of the present disclosure.

A butt pad apparatus is disclosed herein. In various aspects, the butt pad apparatus includes a clamp plate and a recoil pad attachable to the clamp plate such that a chamber is defined sealingly therebetween. The recoil pad with clamp plate attached thereto is adapted for attachment to a butt of a stock, in various aspects. In various aspects, the butt pad apparatus includes an insert removably receivable within the chamber, and the insert may be formed of an elastomeric material.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1:
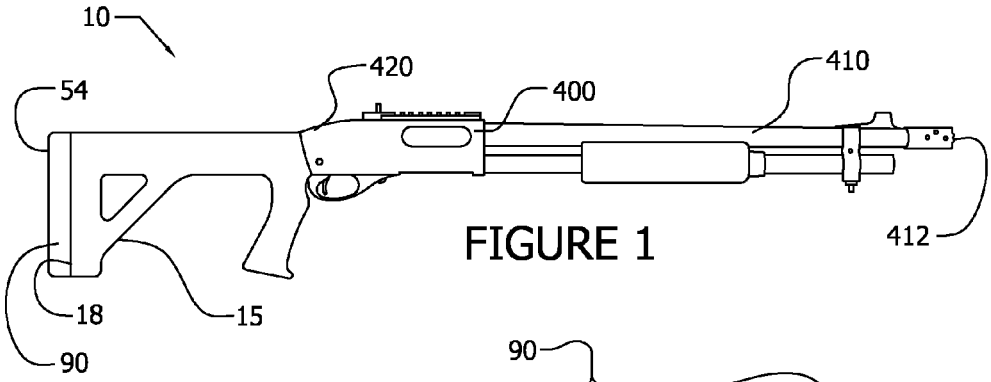
FIG. 1 illustrates by side view an exemplary implementation of a butt pad apparatus.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof.

DETAILED DESCRIPTION OF THE INVENTION

A butt pad apparatus for a firearm is disclosed herein. In various aspects, the butt pad apparatus includes a plate and a recoil pad. The recoil pad is attachable to the plate such that a chamber is defined between the plate and the recoil pad. The plate may be attached to the butt of a stock of a firearm such that the plate is interposed between the butt and the recoil pad, and the recoil pad may be positioned about the user. Accordingly, the recoil pad in combination with the plate may cushion the recoil of the firearm on the user. Various aspects may include several plates that may each have varying structural characteristics or mechanical characteristics, and the several plates may be interposed between the recoil pad and the butt.

An insert may be received within the chamber, and the insert may be formed of an elastomeric material. The user may place the insert within the chamber, and the user may select the insert for placement within the chamber from a number of inserts having a number of differing mechanical properties. Accordingly, the user may customize the butt pad apparatus by placement of a particular insert within the chamber where the insert so placed has mechanical properties that the user may find desirable. The user may interchange several different inserts having varying mechanical characteristics within the chamber as the needs or desires of the user vary.

The user may elect to not place an insert within the chamber, in which case the chamber is empty.

FIG. 1 illustrates an exemplary implementation of butt pad apparatus 10 including assembly 90 and firearm 400. Firearm 400 may be a shotgun, rifle, or other firearm that includes stock 15 with receiver group 420 secured thereto. Barrel 410 with muzzle 412 extends forth from receiver group 420 generally opposite of stock 15. Assembly 90 is secured to butt 18 of stock 15, as illustrated. Surface 54 of assembly 90 may be positioned against a user's shoulder so that butt pad apparatus 10 including assembly 90 cushions the impact of firearm 400 upon the user when firearm 400 is discharged.

Figure 2:
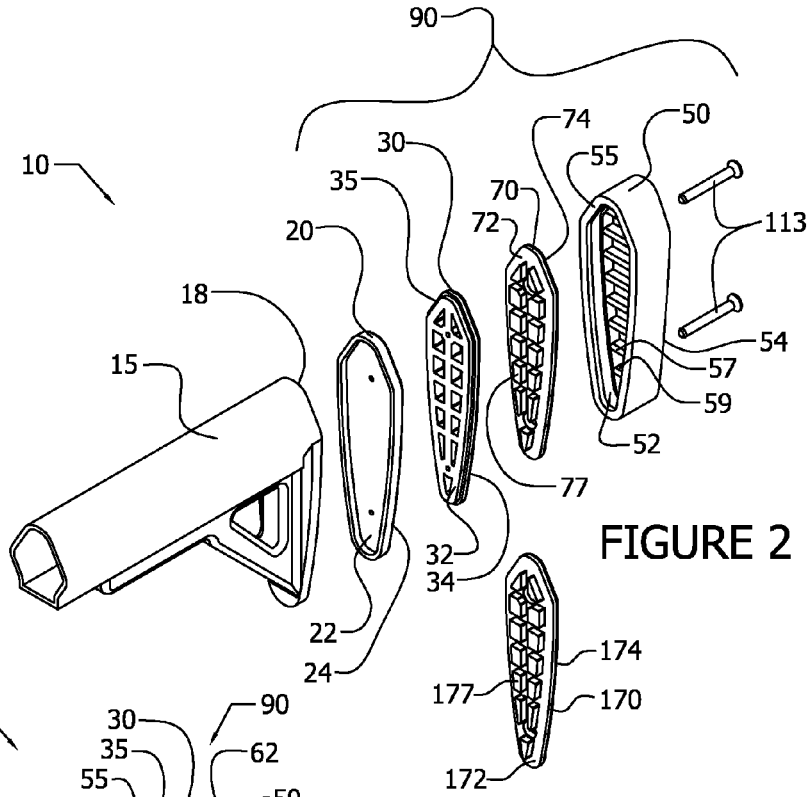
FIG. 2 illustrates by exploded perspective view portions of the exemplary butt pad apparatus of FIG. 1.

FIG. 2 illustrates portions of butt pad apparatus 10 including assembly 90 and portions of stock 15. Assembly 90 may include adaptor plate 20, clamp plate 30, insert 70, and recoil pad 50. Alternatively, assembly 90 may include adaptor plate 20, clamp plate 30, insert 170, and recoil pad 50. As another alternative, assembly 90 may include adaptor plate 20, clamp plate 30, and recoil pad 50, with the insert, such as insert 70, 170, being omitted. Assembly 90 may include, in some implementations, clamp plate 30, insert 70, and recoil pad 50, with the clamp plate 30 being attachable to butt 18 and adaptor plate 20 being omitted. In such implementations, clamp plate 30 may form butt 18 of stock 15.

Clamp plate 30, as illustrated in FIG. 2, includes detent 35 that generally passes about the periphery of clamp plate 30. Recoil pad 50 includes corresponding detent 55 passing about the periphery thereof that may engage detent 35 to secure recoil pad 50 to clamp plate 30 (see FIG. 3). An insert, such as insert 70, 170, may be interposed between clamp plate 30 and recoil pad 50 within chamber 62, in some implementations. The insert, such as insert 70, 170, may be omitted from interposition between clamp plate 30 and recoil pad 50, in other implementations. Fasteners 113 may pass through recoil pad 50 between surfaces 54, 52, through insert 70 between surfaces 74, 72, through clamp plate 30 between surfaces 34, 32, and through adaptor plate 20 between surfaces 24, 22 to engage stock 15 to secure assembly 90 to butt 18 of stock 15. Fasteners 113 may be threaded fasteners or various other types of fasteners that may removably secure assembly 90 or portions thereof to butt 18 of stock 15. Various numbers, sizes, or types of fastener(s), such as fasteners 113, may be used to secure assembly 90 or portions thereof to butt 18 of stock 15, in various implementations.

As illustrated in FIG. 2, with assembly 90 secured to butt 18 of stock 15, surface 22 of adaptor plate 20, surface 32 of clamp plate 30, surface 72 of insert 70, and surface 52 are oriented toward butt 18 of stock 15. Surface 22 of adaptor plate 20 is generally biased against butt 18, surface 32 of clamp plate 30 is oriented toward surface 24 of adaptor plate 20, surface 72 of insert 70 is positioned about surface 34 of clamp plate 30, surface 52 of butt pad 50 is positioned about surface 74 of insert 70, and surface 54 of butt pad 50 faces outward from assembly 90 such that surface 54 of butt pad 50 may be placed against the shoulder of the user. Countersinks may be provided in surface 54 of butt pad 50 to receive the heads of fasteners 113 such that the heads are either flush with surface 54 or recessed into surface 54. Fasteners 113 may be removed by the user in order to detach assembly 90 from butt 18.

Clamp plate 30, as illustrated in FIG. 2, is formed to include a number of openings 37 that pass through clamp plate 30 between surfaces 32, 34. In this implementation, raised elements 77 are formed about surface 72 of insert 70 that correspond to openings 37 in clamp plate 30 such that raised elements 77 are received within openings 37 to secure insert 70 in position with respect to clamp plate 30 when surface 72 of insert 70 is positioned about surface 34 of clamp plate 30.

Surface 74 of insert 70 is generally planar, in this implementation. With recoil pad 50 secured to clamp plate 30 and with insert 70 interposed between recoil pad 50 and clamp plate 30, protrusions 57 formed about surface 52 of recoil pad 50 are biased against surface 74 of insert 70 to hold insert 70 in position between clamp plate 30 and recoil pad 50. As illustrated, protrusions 57 are formed as ribs 59 that pass linearly across surface 52, but protrusions 57, which are raised portions of surface 52, may have other shapes in other implementations. For example, protrusions 57 may have a cylindrical shape, pyramid shapes, or serpentine shape, in various other implementations. Forces, including recoil forces generated by discharge of firearm 400, may be transmitted between insert 70 and recoil pad 50 through protrusions 57, and insert 70 may dampen these recoil forces.

Insert 170, which is illustrated in FIG. 2, may be interposed by the user between clamp plate 30 and recoil pad 50 in substitution for insert 70. Thus, in this implementation, either insert 70 or insert 170 may be interposed between clamp plate 30 and recoil pad 50 as selected by the user, or the insert, such as insert 70, 170, may be omitted by the user. As illustrated, when insert 170 is interposed between clamp plate 30 and recoil pad 50, surface 172 of insert 170 is oriented toward surface 34 of clamp plate 30 such that raised elements 177 are received within openings 37 of clamp plate 30 to hold insert 170 in position, and surface 174 of insert 170, which is generally planar, engages protrusions 57 of surface 52 of recoil pad 50 to transmit forces between insert 170 and recoil pad 50. Insert 170 may dampen these forces.

In various implementations of butt pad apparatus 10, inserts, such as inserts 70, 170, may be formed of generally elastomeric material or combinations of materials such as natural rubber, synthetic rubber such as butyl rubber, ethylene vinyl acetate, and various other elastomers, viscoelastic materials, and so forth. The material(s) may be chosen to dampen recoil forces while maintaining durability of the insert. The insert, such as insert 70, 170, may have a durometer value generally within the range of from about 15 to about 45 on the 00 scale. Insert 70 may be formed of material(s) that differ from the material(s) of insert 170, or insert 70 may be configured in other ways that differ from insert 170 such that the mechanical properties of inserts 70, 170 differ from one another.

The recoil pad, such as recoil pad 50, 250 (see FIG. 8), may be formed of various compliant materials such as natural rubber, synthetic rubber, thermoplastic elastomer, or combinations thereof. The material of which the recoil pad is formed may have a durometer value generally in the range of from about 25 to about 75 on the A scale. The material of the recoil pad may be generally less tacky than the elastomeric material of the insert, which may allow the user to move the firearm from a out of shoulder position to a shouldered position generally without the recoil pad snagging on clothing or gear. The insert within the chamber formed by the recoil pad absorbs the recoil forces to reduce recoil.

The clamp plate, such as clamp plate 30, 230 (see FIG. 8), may be formed of various metals such as steel, aluminum, magnesium, of various plastics, or combinations thereof, and the clamp plate may be formed in an injection molding process, in various implementations. Similarly, the adaptor plate, such as adaptor plate 20, 220, may be formed of various metals such as steel, aluminum, magnesium, of various plastics, or combinations thereof, and the adaptor plate may be formed in an injection molding process, in various implementations. The stock, such as stock 15, may be formed of various woods such as birch or walnut, injection molded plastic, or other such materials or combinations of materials with associated methods of fabrication as would be readily recognized by those of ordinary skill in the art upon study of this disclosure.

Figure 3:
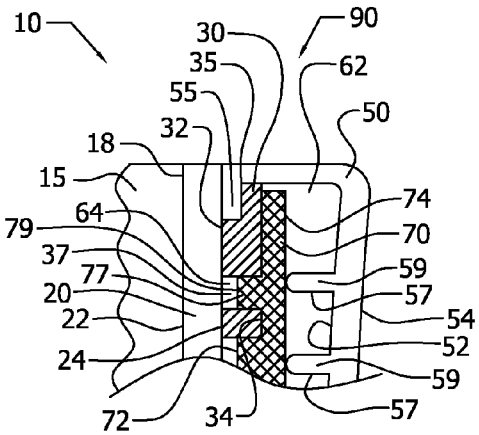
FIG. 3 illustrates by side cross-sectional view portions of the exemplary butt pad apparatus of FIG. 1.

FIG. 3 illustrates portions of assembly 90 of butt pad apparatus 10 secured to butt 18 of stock 15. As illustrated in FIG. 3, adaptor plate 20, clamp plate 30, insert 70, and recoil pad 50 are engaged with one another and secured to butt 18 of stock 15. Detent 35 that extends about the periphery of clamp plate 30 is engaged with corresponding detent 55 that extends about the periphery of recoil pad 50 to secure clamp plate 30 and recoil pad 50 to one another. Portions of surface 24 of adaptor plate 20 are biased against portions of detent 55 to hold detent 55 in engagement with detent 35, as illustrated in FIG. 3. Detent 35, in exemplary butt pad apparatus 10, is configured as a channel, and detent 55 is configured as a lip, but detent 35 and corresponding detent 55 may have other configurations that allow for detent 35 and detent 55 to engage one another and to be disengaged from one another, in various other implementations. The material that forms portions of recoil pad 50 about detent 55 may have sufficient flexure to allow the user to engage detent 55 with detent 35 to attach recoil pad 50 to clamp plate 30 and to allow the user to disengage detent 55 from detent 35 to detach recoil pad 50 from clamp plate 30.

With detents 35, 55 engaged with one another such that clamp plate 30 and recoil pad 50 are secured to one another, surface 34 of clamp plate 30 and surface 52 of recoil pad 50 generally define chamber 62. Chamber 62 may be generally sealed from the external environment to inhibit water, dust, and so forth from entering chamber 62. Detents 35, 55 may be configured to engage one another to seal chamber 62 generally from the external environment.

Insert 70 is interposed between clamp plate 30 and recoil pad 50 within sealed chamber 62, as illustrated in FIG. 3, with raised element 77 of surface 72 received within opening 37 of clamp plate 30, and with generally planar surface 74 contacting protrusions 57 of surface 52 of recoil pad 50. In this implementation, raised element 77 protrudes only partway through opening 37, so that surface 79 of raised element 77 in combination with portions of the walls of opening 37 and portions of surface 24 of adaptor plate 20 defines interstice 64. Surface 79 does not contact surface 24, as illustrated. In other implementations, surface 79 of raised element 77 may be generally coextensive with surface 32 of clamp plate 30, which may essentially eliminate interstice 64 as surface 79 may be in contact with surface 24 of adaptor plate 20. Still other implementations may not include the raised elements 77 and corresponding openings 37.

As illustrated in FIG. 3, protrusions 57 are biased against surface 74 of insert 70. In other implementations, protrusions 57 may be set apart from surface 74 of insert 70 such that protrusions 57 contact surface 74 to transmit forces therebetween, for example, when recoil pad 50 is flexed due to the recoil forces resulting from the discharge of firearm 400. Some protrusions 57 may contact surface 74 while other protrusions 57 may be set apart from surface 74, in various implementations. In other implementations, protrusions 57 may be omitted such that surface 52 may be generally planar, and surface 74 may be either biased against or set apart from the planar surface 52.

Figure 4A:
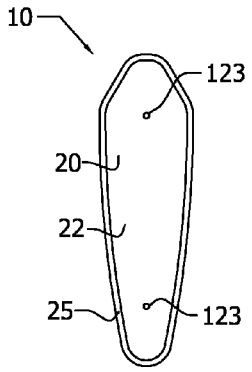
FIG. 4A illustrates by frontal view portions of the exemplary butt pad apparatus of FIG. 1 including an exemplary adaptor plate.
Figure 4B:
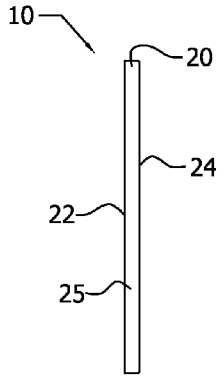
FIG. 4B illustrates by side view the exemplary adaptor plate of FIG. 4A.

FIG. 4A and FIG. 4B illustrate adaptor plate 20 of butt pad apparatus 10. As illustrated in FIG. 4A, rim 25 extends around the periphery of surface 22 of adaptor plate 20. Butt 18 may be generally received within rim 25 to be generally biased against surface 22 of adaptor plate 20, with rim 25 positioning adaptor plate 20 with respect to stock 15. Rim 25 may engage stock 15 to secure, in part, adaptor plate 20 about butt 18 of stock 15. Fasteners 113 may pass through holes 123 in adaptor plate 20. Surface 24 of adaptor plate 20 is generally planar, as illustrated.

Figure 5A:
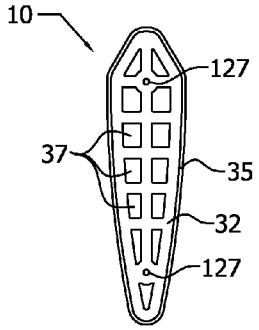
FIG. 5A illustrates by frontal view portions of the exemplary butt pad apparatus of FIG. 1 including an exemplary clamp plate.
Figure 5B:
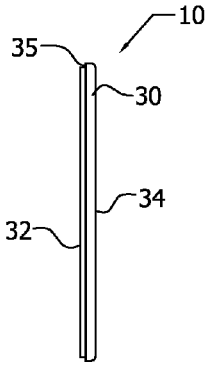
FIG. 5B illustrates by side view the exemplary clamp plate of FIG. 5A.

FIG. 5A and FIG. 5B illustrate clamp plate 30 of butt pad apparatus 10. As illustrated in FIG. 5A, a number of openings 37 of various shapes pass through clamp plate 30 between surface 32 and surface 34. Although illustrated as triangles and quadrilaterals, openings 37 may have various geometries such as, for example, circular or hexagonal, in various other implementations. Fasteners 113 may pass through holes 127 in clamp plate 30 in order to secure assembly 90 including clamp plate 30 to butt 18 of stock 15. Detent 35 is formed around the periphery of clamp plate 30. As illustrated in FIG. 5B, detent 35 is formed as a recessed region around the periphery of clamp plate 30, and sized such that detent 55 of recoil pad 50 may engage within this recessed region of detent 35, and may do so when surface 32 of clamp plate 30 is biased against surface 24 of adaptor plate 20.

Figure 6A:
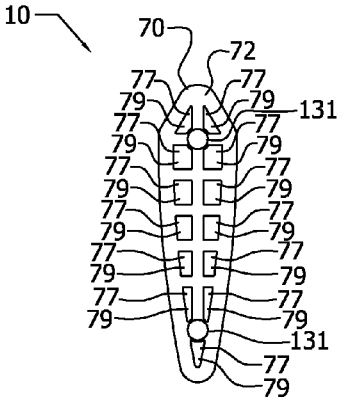
FIG. 6A illustrates by frontal view portions of the exemplary butt pad apparatus of FIG. 1 including an exemplary insert.
Figure 6B:
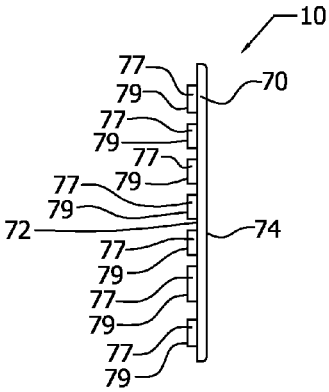
FIG. 6B illustrates by side view the exemplary insert of FIG. 6A.

FIG. 6A and FIG. 6B illustrate insert 70 of butt pad apparatus 10. As illustrated in FIG. 6A, a number of raised elements 77 are formed about surface 72 of insert 70 that correspond to openings 37 disposed about clamp plate 30, which is illustrated in FIG. 5A. Although illustrated as triangular or quadrilateral in shape, raised elements 77 may have any geometric shape that corresponds to the geometric shape of the corresponding openings 37. Accordingly, the raised elements 77 of surface 72 of insert 70 may be received within corresponding openings 37 of clamp plate 30 to secure insert 70 in position with respect to clamp plate 30. Fasteners 113 may pass through holes 131 in insert 70 in order to secure assembly 90 including insert 70 to butt 118 of stock 115. FIG. 6B illustrates raised elements 77 protruding forth from surface 72 of insert 70. Surface 74 of insert 70, which engages surface 52 of recoil pad 50 including protrusions 57 formed thereupon, is generally planar, in this implementation.

Figure 7A:
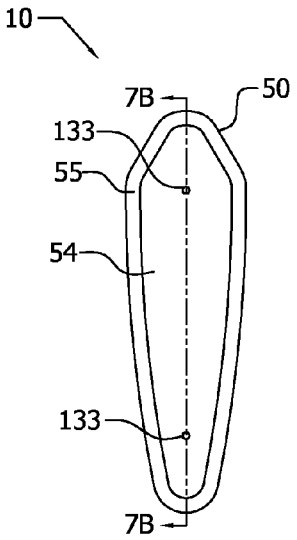
FIG. 7A illustrates by frontal view portions of the exemplary butt pad apparatus of FIG. 1 including an exemplary recoil pad.
Figure 7B:
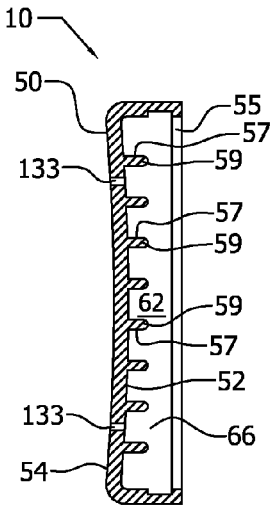
FIG. 7B illustrates by side view the exemplary recoil pad of FIG. 7A.
Figure 7C:
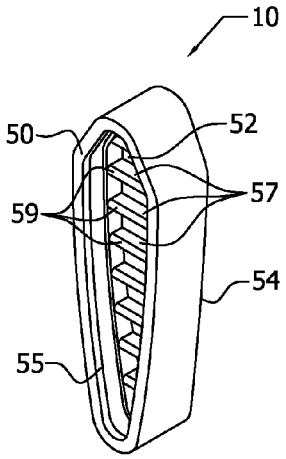
FIG. 7C illustrates by side perspective view the exemplary recoil pad of FIG. 7A.

FIGS. 7A, 7B, and 7C illustrate recoil pad 50 of exemplary butt pad apparatus 10. As illustrated in FIG. 7A, surface 54 of recoil pad 50 is generally smooth, although surface 54 may be configured with checkering or various other patterning, in other implementations. Detent 55, as illustrated, passes around the periphery of recoil pad 50, and is generally formed as a lip adapted to engage the recessed region of detent 35 of clamp plate 30. FIG. 7B illustrates protrusions 57 formed upon surface 52 to transmit forces between recoil pad 50 and an insert, such as insert 70 or insert 170 interposed between recoil pad 50 and clamp plate 30 in chamber 62. The protrusions 57, in this implementation, have the form of ribs 59. Detent 55 is illustrated in FIG. 7B as a lip formed to engage detent 35 of clamp plate 30. As illustrated in FIGS. 7B and 7C, recoil pad 50 is formed in a cup-shape 66 with the cup shape-66 in conjunction with surface 34 of clamp plate 30 defining chamber 62. FIG. 7C illustrates a further view of recoil pad 50 including protrusions 57 formed as ribs 59 passing linearly across surface 52. Detent 55 is also illustrated in FIG. 7C.

Figure 8:
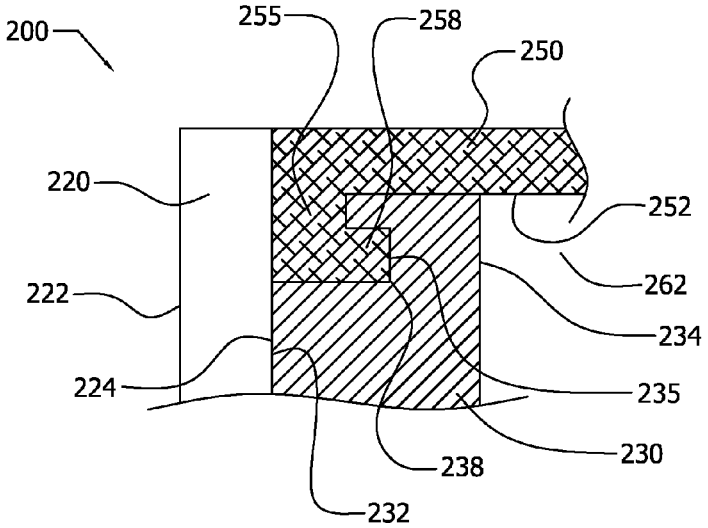
FIG. 8 illustrates by cross-sectional view portions of another exemplary implementation of a butt pad apparatus.

FIG. 8 illustrates portions of butt pad apparatus 200 including the coupling of recoil pad 250 to clamp plate 230. Surface 234 of clamp plate 230 in combination with surface 252 of recoil pad 250 define chamber 262, and an insert such as insert 70, 170 may be positioned about surface 234 of clamp plate 230 within chamber 262, in this implementation. As illustrated in FIG. 8, adaptor plate 230 included detent 235 configured as groove 238 that passes around the periphery of adaptor plate 230. Recoil pad 250 includes detent 255 formed as flange 258 that is reversed upon itself 180° to engage groove 238, as illustrated, with flange 258 passing around the periphery of recoil pad 250. Surface 224 of adaptor plate 220 is biased against surface 232 of clamp plate 230 and portions of recoil pad 250 proximate flange 258 to hold flange 258 in groove 238 thereby securing recoil pad 250 to clamp plate 230. Surface 222 of adaptor plate 220 may be engaged with butt 18 of stock 15 so that surfaces 232, 252 are orientated toward butt 18.

The user may assemble an assembly, such as assembly 90, of a butt pad apparatus, such as butt pad apparatus 10, 200, and secure the assembly to the butt of a firearm, such as butt 18 of firearm 400 using the following operations. The user may assemble the assembly by interposing an insert, such as insert 70, 170, within a chamber, such as chamber 62, between a surface of a recoil pad, such as surface 52, 252 of recoil pad 50, 250, respectively, and a surface of a clamp plate, such as surface 34, 234 of clamp plate 30, 230, respectively. The user may secure the recoil pad to the clamp plate by attaching a detent, such as detent 35, disposed about the clamp plate to a detent, such as detent 55, disposed about the recoil pad. The detents cooperate with one another to secure releasably the clamp plate to the recoil pad in this example. A surface of an adaptor plate, such as surface 22, 222 of adaptor plate 20, 220, respectively, may be positioned about the butt, and a surface, such as surface 32, 232, of the clamp plate may be positioned about a surface, such as surface 24, 224, respectively, of the adaptor plate, the clamp plate being secured to the recoil pad with the insert interposed between the clamp plate and the recoil pad. Fasteners, such as threaded fasteners 113, may be passed through the recoil pad, insert, clamp plate, and adaptor plate, to engage the stock, such as stock 15, to secure the assembled recoil pad, insert, clamp plate, and adaptor plate assembly to the stock. In some implementations, the adaptor plate may be omitted, in which case the clamp plate is secured to the butt of the stock. In some implementations, the insert is omitted, in which case no insert is interposed between the recoil pad and the clamp plate.

In operation, the user may selectively place various inserts within the chamber between the recoil pad and the clamp plate, or the user may elect not to include an insert within the chamber between the recoil pad and the clamp plate. In order to place a different insert within the chamber between the recoil pad and the clamp plate, the user may reverse the above operations for attachment of the assembly as described above to remove the assembly from the butt of the stock and do disassemble the assembly. With the assembly removed from the butt of the stock, the detents may be released from engagement with one another, which releases the recoil pad from engagement with the clamp plate. The insert, if any, may then be removed from the chamber between the recoil pad and the clamp plate, and a different insert, as selected by the user, interposed between the recoil pad and the clamp plate. The detents may be reengaged with one another to secure the recoil pad to the clamp plate with the different insert interposed between the recoil pad and the clamp plate. Alternatively, the insert may be removed from the chamber, and then the detents reengaged with one another to secure the recoil pad to the clamp plate with no insert interposed within the chamber between the recoil pad and the clamp plate. The butt pad apparatus may include tool(s) configured for the insertion and removal of the fasteners. The butt pad apparatus may include tool(s) configured to assist the user in engaging the detents to attach the clamp plate and recoil pad to one another or to assist the user in disengaging the detents to disengage the clamp plate and the recoil pad from one another.

The foregoing discussion along with the Figures discloses and describes various exemplary implementations. These implementations are not meant to limit the scope of coverage, but, instead, to assist in understanding the context of the language used in this specification and in the claims. Upon study of this disclosure and the exemplary implementations herein, one of ordinary skill in the art may readily recognize that various changes, modifications and variations can be made thereto without departing from the spirit and scope of the inventions as defined in the following claims.

The invention claimed is:

1. A butt pad apparatus, comprising:

a recoil pad attached to a stock such that a chamber is defined therebetween in part by an inside surface of the recoil pad, the recoil pad comprising an elastomeric material;

a plate interposed between the recoil pad and the stock such that a surface of the plate defines a portion of the chamber;

a removable insert configured to removably couple to the plate in a user interchangeable manner, wherein the removable insert is interposed between the plate and the recoil pad such that the insert is removably received within the chamber, the insert comprising an elastomeric material;

a second removable insert interchangeable with the removable insert with only one of the removable inserts being installed at a time, the second insert comprising a second elastomeric material differing from the elastomeric material; and a detent formed about a periphery of the plate engaged with a detent formed about a periphery of the recoil pad to attach the plate, and the recoil pad to one another, the detents formed such that the chamber is generally sealed when the recoil pad is attached to the plate.

2. The apparatus, as in claim 1, wherein the elastomeric material of the insert is chosen from the group consisting of natural rubber, butyl rubber, and ethylene vinyl acetate.

3. The apparatus, as in claim 1, wherein the elastomeric material of the insert has a durometer value within the range of from about 15 to about 45 on the OO scale.

4. The apparatus, as in claim 1, wherein the recoil pad is configured in a cup-shape with the cup-shape defining a portion of the chamber.

5. The apparatus, as in claim 1, further comprising:

a plurality of openings formed about the plate adapted to engage corresponding raised elements formed about a surface of the removable insert with each raised element being received in an associated opening to removably couple the insert to the plate and to removably secure the insert in position within the chamber.

6. The apparatus, as in claim 1, further comprising:

a second plate interposed between the plate and the stock.

7. The apparatus, as in claim 1, wherein the recoil pad and the insert are engaged with the stock by a threaded fastener.

8. The apparatus, as in claim 1, wherein the removable insert is removably coupled to the plate solely by frictional engagement of the removable insert with the plate.

9. The apparatus, as in claim 1, further comprising protrusions formed upon the inside surface of the recoil pad adapted to engage the insert to transmit forces between the recoil pad and the insert.

10. The apparatus, as in claim 9, wherein the protrusions have the form of elastomeric ribs.

11. A butt pad apparatus, comprising:

a recoil pad attachable to a butt of a stock such that a chamber is defined therebetween in part by an inside surface of the recoil pad, the recoil pad comprising an elastomeric material;

a plate interposed between the recoil pad and the stock such that a surface of the plate defines a portion of the chamber;

a removable insert configured to removably couple to the plate in a user interchangeable manner, wherein the removable insert is interposed between the plate and the recoil pad such that the insert is removably received within the chamber and removably attached to the plate, the insert comprising an elastomeric material;

a second removable insert removably received within the chamber in replacement for the removable insert, the second insert having mechanical properties differing from the mechanical properties of the insert; and a detent formed about a periphery of the plate adapted to engage a detent formed about a periphery of the recoil pad to attach the plate and the recoil pad to one another, the detents formed such that the chamber is generally sealed when the recoil pad is attached to the plate.

12. The apparatus, as in claim 11, wherein the elastomeric material of the insert is chosen from the group consisting of natural rubber, butyl rubber, and ethylene vinyl acetate.

13. The apparatus, as in claim 11, wherein the elastomeric material of the insert has a durometer value within the range of from about 15 to about 45 on the OO scale.

14. The apparatus, as in claim 11, wherein the recoil pad is configured in a cup-shape with the cup-shape defining a portion of the chamber.

15. The apparatus, as in claim 11, further comprising:

a plurality of openings formed about the plate adapted to engage corresponding raised elements formed about a surface of the removable insert with each raised element being received in an associated opening to removably couple the insert to the plate and to removably secure the insert in position within the chamber.

16. The apparatus, as in claim 11, wherein the removable insert is removably coupled to the plate solely by frictional engagement of the removable insert with the plate.

17. The apparatus, as in claim 11, further comprising protrusions formed upon the inside surface of the recoil pad adapted to engage the insert to transmit forces between the recoil pad and the insert.

18. The apparatus, as in claim 17, wherein the protrusions have the form of elastomeric ribs.

* * * * *